US007754140B2

(12) United States Patent
Rajner et al.

(10) Patent No.: US 7,754,140 B2
(45) Date of Patent: Jul. 13, 2010

(54) METHOD AND DEVICE FOR PRODUCING DIMENSIONALLY ACCURATE FOAM

(75) Inventors: Walter Rajner, Tettenhausen (DE); Frantisek Simancik, Bratislava (SK)

(73) Assignee: Alulight International GmbH, Ranshofen (AT)

( * ) Notice: Subject to any disclaimer, the term of this patent is extended or adjusted under 35 U.S.C. 154(b) by 554 days.

(21) Appl. No.: 10/550,616

(22) PCT Filed: Mar. 25, 2004

(86) PCT No.: PCT/EP2004/003183

§ 371 (c)(1),
(2), (4) Date: Mar. 19, 2007

(87) PCT Pub. No.: WO2004/085688

PCT Pub. Date: Oct. 7, 2004

(65) Prior Publication Data

US 2007/0158877 A1 Jul. 12, 2007

(30) Foreign Application Priority Data

Mar. 25, 2003 (DE) ..... 103 13 321

(51) Int. Cl.
*B22F 3/10* (2006.01)

(52) U.S. Cl. ..... 419/2

(58) Field of Classification Search ..... 419/2
See application file for complete search history.

(56) References Cited

U.S. PATENT DOCUMENTS

| | | | | |
|---|---|---|---|---|
| 2,983,597 | A | 5/1961 | Elliott | |
| 5,255,729 | A | 10/1993 | Cook | |
| 6,391,250 | B1 * | 5/2002 | Wolfsgruber et al. | 419/2 |
| 2002/0127425 | A1 | 9/2002 | Wolfsgruber et al. | |

FOREIGN PATENT DOCUMENTS

| | | | |
|---|---|---|---|
| AT | 406 558 | B | 6/2000 |

(Continued)

OTHER PUBLICATIONS

Machine translation of DE 19954755 (May 17, 2001) from EPO website.*

(Continued)

*Primary Examiner*—Roy King
*Assistant Examiner*—Jie Yang
(74) *Attorney, Agent, or Firm*—David S. Safran; Roberts Mlotkowski Safran & Cole, P.C.

(57) ABSTRACT

A method for producing dimensionally accurate metal foam from a foamable, powder metallurgically produced metal semifinished product having a melting point >200° C. involving: the introduction of material, which is capable of foaming above 200 ° C., into a mold which has a coefficient of expansion of less than 3 $K^{-1}$ Controlled heating of the foamable material inside the mold is performed while radiators foam the material, and the foamed product formed thereby removed from the mold. A device for producing dimensionally accurate thermally foamed metal foam parts that is has a thin-walled mold, which is stable at the melting temperature of the metal foam and which has a coefficient of expansion of <3$K^{-1}$; a controllable irradiating device, and; a controller that controls the irradiating device based on the measurement given by a radiation measuring device.

12 Claims, 3 Drawing Sheets

FOREIGN PATENT DOCUMENTS

| | | | |
|---|---|---|---|
| DE | 197 53 658 | A1 | 6/1999 |
| DE | 19954755 | A1 | 5/2001 |
| DE | 199 12 618 | C2 | 6/2002 |
| JP | 10-158760 | A | 6/1998 |
| JP | 2002-371327 | A | 12/2002 |

OTHER PUBLICATIONS

Derwent ACC-No. 2000-580892 for patent family including DE 19954755 (May 17, 2001).*

F. Simancik et al., Effect of Foaming Parameters on the Pore Size, Metal Foams and Porous Metal Structures, MIT Verlag (1999).

Tafelwerkmathematik Physik Chemie, Zahlentafeln, Wertetabellen Und Formein Fur Die Klassen 7 Bis 12, Ausgabe 1967, Berlin: Volk Und Wissen Volkseigener Verlag, Berlin, 1969, S. 37.

Internet Site: http://de.wikipedia.org/wiki/L%C3%A4ngenausdehnungkoeffizient; English Translation.

* cited by examiner

Providing a diatherman mould having a linear expansion coefficient < $3K^{-1}$

↓

Inserting foamable material, optionally with separating agent and functional elements

↓ controlled irradiation with wavelengths in the range of 800 - 5000 nm while foaming the material

↓ cooling off the mould with material

↓

Taking the dimensionally accurate foam part out of the mould.

FIG. 1

METHOD AND DEVICE FOR PRODUCING DIMENSIONALLY ACCURATE FOAM

BACKGROUND OF THE INVENTION

1. Field of Invention

The invention relates to a method for producing dimensionally accurate metal foam from foamable, powder-metallurgic semi-finished metal products having a melting point >200° C., as well as to devices for carrying this out.

2. Description of Related Art

Production of foam from suitable foamable material for plastics, natural substances, glasses and also metal-containing materials, is known.

Methods for powder-metallurgic metal foam production in molds having low expansion coefficient are known from German Patent Application DE 199 54 755 A1. There, AlSi12 alloy is foamed in a powder metallurgical manner; however, the information given there is only suited for this material, as continuously material-dependent magnitudes are mentioned. This also holds good for the necessary 5-25 nm thick protection layer of the quartz glass mold by an Al2O3-coating of the quartz glass, as well as for the applied cover layer which is necessary on account of the reactivity of the foaming AlSi12. There, also through a thick-walled mold with layer thicknesses >5 mm and an applied protection layer is coupled radiation in mid-infrared, whereby the infrared emitter is geometrically arranged in such a way, that heat sinks occur in the powder compact. This known method can only work with powder compacts which are applied on cover layers and there occur problems with nonuniform heating of the mold, which results in nonuniform foam samples and foams which are not dimensionally accurate which, particularly in the case of larger foam parts, leads to instability of the foam and hence to cracks, weak points etc.

So far, it has been extremely difficult to produce metal foam parts which are dimensionally accurate of satisfactory quality. It is a problem to achieve a uniform pore distribution in larger components, e.g., large-surfaced ones like metal foam plates with a base area of 0.5 $m^2$ and more. Such metal foam parts produced according to the known foaming methods often have regions in which the pores are collapsed, and as a result, large hollow spaces are present which weaken the stability of the component. In case of parts with nonuniform thickness or such ones with regions of higher density, which occurs by inserting more semi-finished products at pre-determined points, particularly, very often defects occur. This is especially due to the fact that traditional molds of metal have a high linear expansion coefficient and a high heat capacity. The expansion coefficient leads to the situation, that great dimensional changes take place on cooling, which negatively influence the dimension-precision and the cooling behavior of the metal foam. Known molds or casting molds require a lot of energy for heating, due to which the cooling takes a long time and results in long cycle periods in production. The cooling can also lead to material problems in metal foam, in case composites are supposed to be foamed and too long dwelling in a fluid condition leads to undesirable reactions or dissolutions, like de-mixing phenomena. A further problem is that, in the known foam processes in furnaces, an uncontrolled heat distribution in the casting mold leads to uncontrolled foaming of the foamable material, and hence, one does not get a satisfactory pore distribution.

In other known methods, the semi-finished product is heated up in metal casting molds in a furnace to a temperature which lies clearly above the melting temperature of matrix metal of the semi-finished product. In order to achieve an adequate productivity of the process and above all good quality of the metal foam, the heating also takes place very rapidly, i.e., within a few minutes. On the other hand, a very specific heating of the foamable material is very necessary, as otherwise, individual regions of the semi-finished product do not get foamed, whereas other regions get over heated and the foam cells there collapse. Therefore, the casting mold must be heated in a very short time—e.g., with the least possible temperature differences for plane metal foam of uniform thickness—, which is particularly difficult for larger molds or casting molds and metal foam parts. A big problem in this case is the large heat capacities of known casting molds, which cannot be easily cooled rapidly and, on account of the high heat conducting capacity of the metal, do not allow locally differentiated heating.

The known method of foaming in metal molds in a furnace was disadvantageous because it was difficult to control, had to be often interrupted and, one could not run the process continuously. Finally, the energy costs were also quite high.

SUMMARY OF THE INVENTION

The object of the present invention to present a method which allows production of uniformly foamed foam parts, even ones having large overall dimensions.

This object is achieved in accordance with the invention by a method comprising the steps of:

- introducing a material foamable at a temperature greater than 200° C. into a mold which is heat resistant up to the melting point of the foamable material and having a expansion coefficient less than 3 $K^{-1}$, and preferably less than 1$K^{-1}$;
- controlling heating of the foamable material in the mold during foaming with the help of a radiation emitter whose energy emission is controlled, the radiation being applied on or through the mold; and
- removing the thus foamed foam product from the mold.

This object is also achieved in accordance with the invention by a device having a thin-walled casting mold which is stable at the melting temperature of the metal foam and has a expansion coefficient of the magnitude of graphite and yttrium oxide; a controllable radiation unit; and a control system which controls the radiation mechanism on the basis of measurements obtained by a radiation measuring unit.

References to metal foam below also includes bodies which are formed essentially of metal foam, and also having non-foamed reinforcing elements like wires, grids, plates or even threads, filaments, whiskers, fastening elements like bolt bushes, hollow bodies like nonfoamed pipes etc. These structural elements could be connected during foaming of metal foam by means of positive fit or even material-fit; in this way, one can avoid later fastening steps like boring, slitting or other mechanical joining methods, or adhesion bonding, welding, soldering or such processes.

The invention particularly pertains to metal foams of metals or metal composites foamed thermally at high temperatures over 200° C., preferably over 300° C. or even over 500° C. with the help of foaming agents.

The foams can be used as solid but even light construction materials. Such light construction materials find application in the construction sector as cover elements, light-weight load-bearing elements; in motor vehicle technology, as well as in aircraft—, automobile— and ship construction, or even as acoustic isolation panels or protection panels against mechanical or thermal actions (fire-preventing components).

By "non-uniform" it is meant that the momentary distribution of radiation in the mold, as well as the time-related application of radiation, i.e., the irradiation of the mold, with different irradiation intensities as well as the time-differentiated irradiation of particular mold regions. Surprisingly, in this way, one can control the metal foam generation and avoid occurrence of gas occlusions.

By metal foam, it is meant here a foamed product which has defined outer dimensions.

The method can be carried out in a very advantageous manner with foamable materials having a melting above 200° C., preferably above 300° C. or even melting points above 500° C.

Because, in this case, molds or casting molds having lower linear coefficients of expansion and lower heat capacity, as well as controlled foam generation is used, one can obtain an extremely dimensionally accurate metal foam part. Suitable mold materials are ceramic or glass-type materials or even composite materials like fiber-reinforced composites like fiber-reinforced ceramic, glass or carbon, which are highly heat permeable and fulfill the requirements of low expansion coefficient with enhanced stability under pressure and tension. It is also possible to cool off the molds very rapidly, as the low expansion coefficient prevents damages which could occur due to a longer cooling process in case of traditional molds.

The process can also be carried out continuously in a preferred embodiment which leads to a strand-type or band-type metal foam product. In this case, molds open on both sides are used, whereby foamable material is introduced continuously into the mold/casting mold, which is irradiated in a controlled manner in a selected region and the foamable material is thus heated and foamed; whereby, on the other side, depending on the mold or casting mold, the metal foam comes out foamed in the form of strands. Even here, the method can be supported by a separating material, in case the metal to be foamed adheres strongly to the mold—e.g., by letting foil-type separating material run along, like Al2O3, or ZrO2-containing foils or graphite foils for aluminum foaming, or by coating the foamable material with separating material foils, or by coating with a high temperature cinder base like silicate base; suitable separating agents are known to the expert.

The mold should preferably be at least partly diatherman. By diathermic one generally refers to material which is permeable for heat radiation, in this case, is radiation permeable in the range of approx. 760-5000 nm. As suitable radiation source, one could use those emitting continuously in the range of 760-5000 nm, or even selected wave length emitting emitters, like pins, Nemst-pins, SIC-rods, LEDs, CO2—CO—, diodes-, Nd/Yag lasers, semiconductor or color lasers. Their energy output can be regulated by regulating the supply current or by using a filter.

The casting mold should preferably be thin-walled. This would be advantageous because one can avoid wastage of heat energy for heating up a casting mold having high heat capacity, and its cooling behavior is faster—which prevents separation of composite foams, longer time cycles and allows precise controlling of the heat energy acting on the material to be foamed. The mold could, for example, have a wall thickness of from 1-20 mm, more preferably, a thickness of 2-10 mm. In the case of thin mold walls, on account of heat management, it could be sensible to externally support them mechanically, locally by supports or beams, in order to prevent bending or breaking of the mold in case of heavy metal foams or larger parts and to ensure retention of the dimensions. Suitable supports could be studs, or grid-type or honeycomb-like constructions, which would have as small a support surface as possible, low heat conductivity and heat expansion coefficient and would consume less heat energy, in order not to disturb the heating profile. In the case where the studs can be regulated, it would be advantageous to compensate for unevenness of the casting mold or the heat expansion of the supports themselves.

The casting mold can be fed with a suitable gas—even under over pressure. Ideally, an inert gas is used under not too high an overpressure in the range of below approx. 5 bar. Thus, one can conduct foaming of several non-precious metals or their alloys or composites, like Zn, Ni, Al, Mg, Ca, Ni, Fe, Sn.

Metal powder mixings can be carried out, or even mixings of precious metal, copper, beryllium, tungsten, titanium, steels, Si or their alloys, if required with additives, like hard substances, fiber and foaming agents for producing the metal foams, like hydride- or carbonate of metals—e.g., TiH2, ZnH2, MgH2, CaCO3 etc., as already known to experts in the field of metal foam production. Particular reference is made to substances that release gases at higher temperatures, preferably such substances which are absorbed in the foam metal by formation of alloys after setting free the gas. Typical metal foam materials are ones which have a large share of Al, Be, Mg, Si, Cu, Zn, Ti, Sn, Pb, lead, brass, bronze etc. With the help of the method of the invention, one can also process fusion-metallurgical unproducible alloys. Typical are titanium alloys, like TiAl, TiAlNb, certain magnesium or beryllium alloys, as known to the expert. One can also use composites, like glasses. Typical oxidation-prone metal alloys are those of Mg, Ca, Al, Zn, Fe, Sn, but by no means restricted to these.

Foaming under normal atmosphere is possible, but leads to thicker walls of the pores, larger pores and generally to lower achievable porosity than in the case of protecting atmosphere. The cost-effective variant of normal atmosphere, on account of saving expensive gases, should preferably be used in case of particularly oxidation-prone metals, like in the case of some Al-alloys. The foamable material could also be a foamable plastic or foamable metal semi-finished product—like powder-metallurgic, cold-compacted, heat-compacted, or even extruded mixtures of metal powder with foaming agents, like metal hydrides, e.g., TiH2, ZrH22, MgH2, carbonates, nitrides, hydrocarbonates, or mixtures of oxides with carbon, as already known to the experts. These starting materials could also be introduced into the mold or casting mold together with reinforcement elements or structural elements, like hooks, bolt sleeves or such items, as well as reinforcement parts-nets, filaments, threads or even cover foils, in order to obtain a decorative, or at the same time, protective layer of the metal part, or to fix connecting components therein. The final spatial arrangement of reinforcing parts or layers can be ensured by providing consumable holding elements in the molds. Preferably, the casting mold—if it is closed—should be closable gas-tight and should have an overpressure valve, as well as a gas inlet and outlet.

However, it could also be meaningful, in case a precise shaping of a surface is not necessary or desirable, that the casting mold is open at least from one side and foaming is carried out in the casting mold which is open on one side. The thus produced parts have an at least free-foamed, geometrically interesting surface, whereas the other surfaces are shaped dimensionally accurate.

It can be provided, that a controlled gas atmosphere is set and maintained in the casting mold. The closed casting mold should withstand gas pressure between 2 to 5 bar. During foaming, even a pressure change can be effected—in which case, if an abrupt reduction of gas pressure is carried out in the foaming material, one gets production of metal foam with fine and more uniform pores. The atmosphere in the casting mold during the foaming process can be adjusted with respect to its composition as well as with respect to the pressure prevailing in the casting mold during foaming. Cost-effective air is suitable as the gas—in case oxidation plays only a subordinate role—however, one can also work with inert gas or any other gas which does not react in any significant manner with the foaming material, e.g., nitrogen or argon. However, if a gas reaction with metal foam components is desired—e.g., formation of nitrides in metals—one could also use a suitable reacting gas.

In a preferred embodiment, the casting mold is at least partly diathermic and the content of the mold can be specifically locally heated by controlled radiation and foamed. For this, it would be suitable to use a laser with emission wave lengths in the range of around 3000 nm or other suitable emitters of thermal radiation with a high share of radiation in the wave length range of approx. 760-5000 nm.

In special cases, it could be meaningful to cover the mold or casting mold material with a separating agent suited to the material to be foamed—this can be done either by coating the mold or by placing foils like fiber mats or material foils, like metal foils. The separating material can also be directly applied in foil form on the foamable material. The separating agent is not always necessary, but prevents reactions between the metal foam material and the casting mold, produces a structural surface in case of smooth mold surface and can also allow relative movement of the metal foam relative to the mold, in case there is a separating foil.

It is particularly desired that the heat radiation is generated from controllable emitters because, in that case, the foaming can be effected in a controlled manner and regions of the casting mold, which are supposed to produce a larger metal foam thickness, can be supplied accordingly with more heat energy. However, one could also use a single radiation source, like a laser, with a corresponding radiation splitting. The radiation emission of the emitter is monitored with the help of suitably arranged sensors and controlled according to the measured signals emitted by these. Thus, one can set and carry out a pre-defined heating profile, in order to specifically control pores distribution and the foaming process. This is particularly important in the production of products with non-uniform thickness or density, as a specific foaming front has to be reached in order to obtain a product with desired pores distribution, without undesirable gas occlusions.

If the process is to be carried out continuously, it could be advantageous if the casting mold is open on both sides and the foamable material is heated and expanded in a controlled manner in the open casting mold through radiation, while the foamable material is continuously introduced into the open mold—preferably with a separating foil.

Further objectives, features and advantages can be obtained by carefully considering the following description and the claims, along with the accompanying drawings. For more complete understanding of the nature and objectives of the invention, it is referred to the drawings.

BRIEF DESCRIPTION OF THE DRAWINGS

FIG. 1 is a flow diagram of the process steps in accordance with the invention;

DETAILED DESCRIPTION OF THE INVENTION

Preferred embodiments of the invention are described below on basis of production of metal foam plates; however, the invention is not restricted in any way to the special material or molds mentioned there. According to this method, one can also similarly foam at high temperatures other meltable metals, like nickel, tin, aluminum, magnesium, silicium, titanium, metal alloys like bronze, glass or even glasses and thermoplastic plastics.

EXEMPLARY EMBODIMENTS

Example 1

Foaming of Zinc

Figure 2:
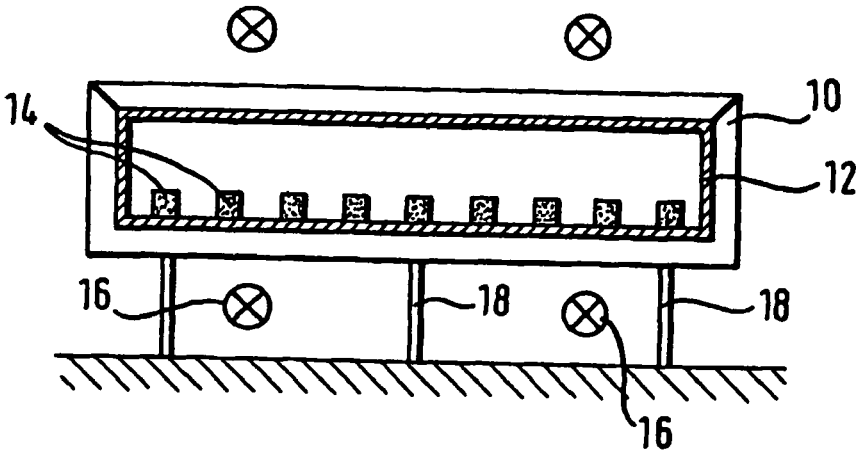
FIG. 2 is sectional view of an arrangement for conducting the process of the invention.
Figure 3:
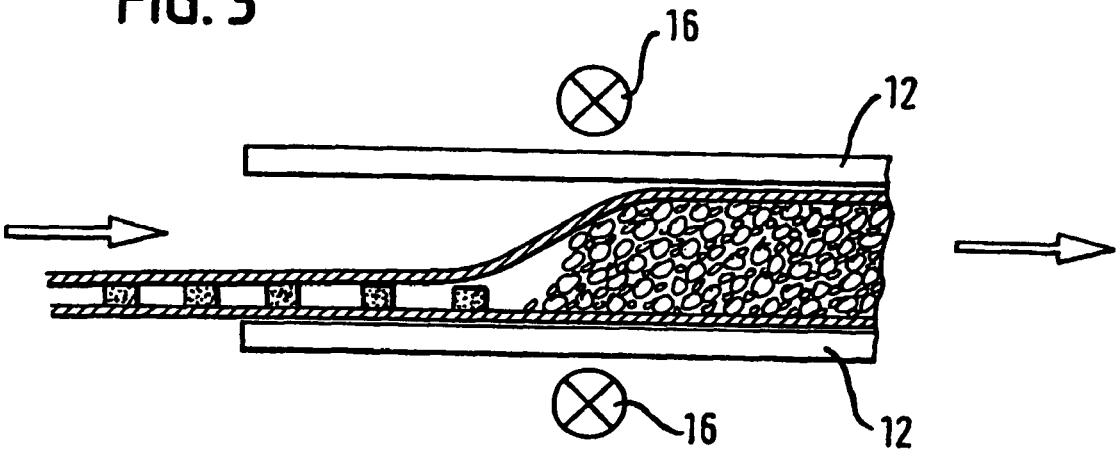
FIG. 3 is a cross-sectional schematic view of an arrangement performing a continuous process in accordance with the invention.

Foamable, powder-metallurgically produced zinc semi-finished product 14 of a Zn alloy with 14 wt. % of Al, 0.8 wt. % of ZrH2, 84.2 wt. % of Zn was produced through cold-compacting of powder material, and then introduced into a box mold 10, with over pressure valve, made of diathermic silicium ceramic with a linear expansion coefficient of 0.5 K−1 and sealable—as schematically shown in FIG. 2—and the cover of the box mold was closed in a gas-tight manner. The ceramic box mold was treated with separating agent before introducing the zinc semi-finished product.

The mold was subsequently evacuated, gassed with argon and an overpressure of 2 bar set in the mold. Optically aligned radiation with an emission wave length maximum in the range of 3000-5000 nm was directed—according to a previously conducted pyrometer measurement of the radiation profile—on to the diathermic mold surfaces according to the pre-determined heating profile with foaming of the foamable material. After a predetermined time period, the heat radiation was switched off and the mold cooled rapidly by means of air circulation with the help of a fan. The completely foamed zinc foam plate was removed from the mold. The thus produced plate revealed a very high mold loyalty and uniform foam quality.

Example 2

Foaming of Aluminum

Cold- or hot-compacted foamable powder-metallurgically produced material parts 14 made of AlMg0,6SiO,4 with 0.4% TiH2 were placed into a closable diathermic casting mold 10 made of Y2O3-ceramic having a quadratic base and wall thickness of 1 cm and an area of 1 m×1 m and then the mold closed. The lower surface of the mold was uniformly supported on its lower side by means of pin-like supports 18, in order to prevent deformation thereof while introducing heavy metal. Then, thermal radiation from emitters 16 with an emission maximum in the range of over 3000 nm controlled over a sensor field—was uniformly directed onto the lower and upper surface of the mold, whereby the foamable material was heated, foamed-up and filled the mold.

The temperature of the material during foaming was approx. 600° C. Here, the mold or casting mold material was protected by a graphite-containing foil, which was applied before introducing the semi-finished product into the mold or casting mold surfaces. The foaming was performed here without protective gas. The mold was then opened and the foamed aluminum foam plate is removed. The plate was dimensionally accurate and had uniform pore distribution.

Example 3

Foaming of Aluminum

The method was conducted as described in example 2, whereby the mold 10 was kept under an $N_2$-overpressure of 2.5 bar during foaming. The thus obtained formed part had smaller pores and thinner pore walls. It was found that the size of the pores and wall thickness of the generated metal foam could be controlled through the mold inner pressure as well as the type of gas present during foaming.

Example 4

Production of an Angular Part

An angular mold, at least partly made of a diathermic ceramic material (see schematic depiction in FIG. 4), was coated with carbon 12 and then foamable material 14 was introduced into it. The further process of foaming took place as described in Example 2.

Example 5

Foaming in Open Mold

Figure 4:
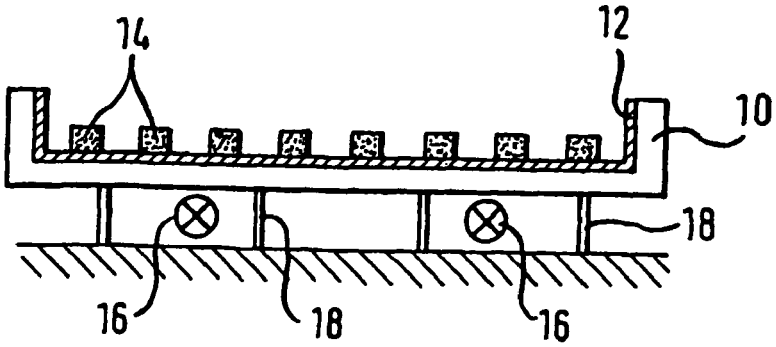
FIG. 4 is a representation of foaming in open mold.
Figure 5:
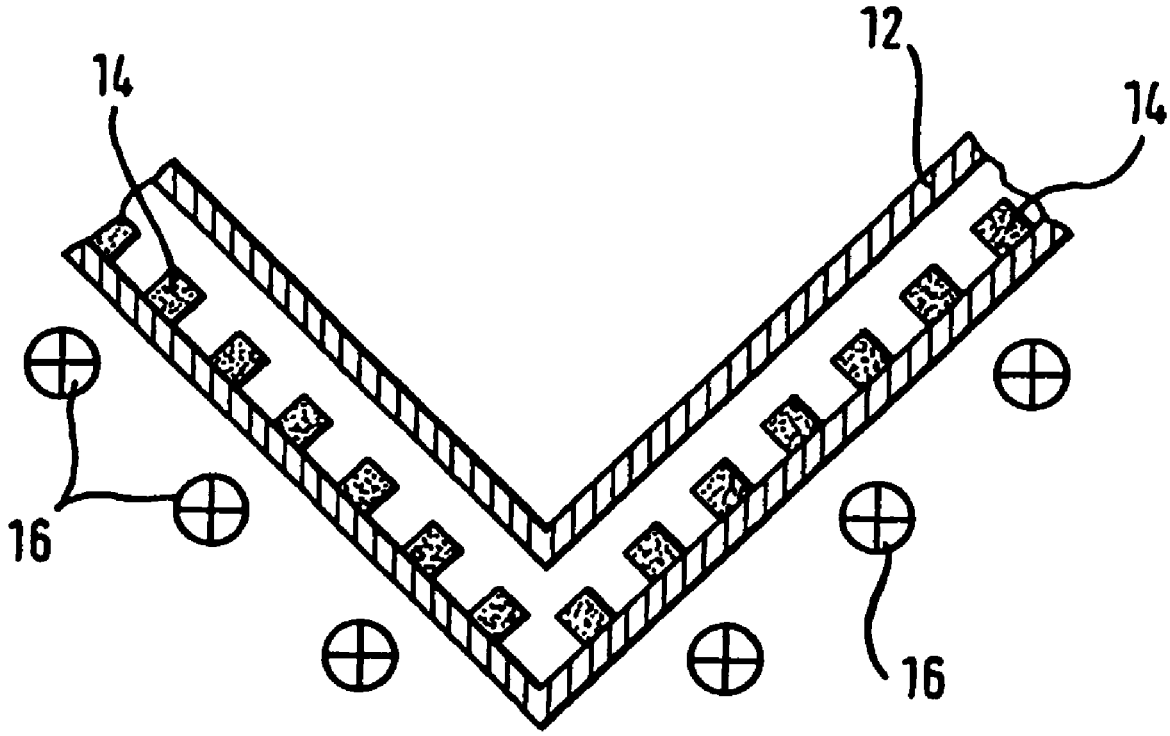
FIG. 5 is sectional view of a mold for producing angular elements.

A box-shaped mold, as shown in FIG. 4, with a bottom surface made of diathermic ceramic, was uniformly heated with the help of a flatly arranged and controlled emitter 16 with an emission wave length maximum of 3050 nm. Cold-compacted semi-finished product parts 14 of AISi10Mg1 with 0.4% TiH2 were placed on copper foil 12. A foam part was obtained with a precise base and side areas comprising copper, whereas the surface made of aluminum alloy has a geometrically freely foamed, optically appealing shape. Such parts are suitable, in cases where a freely foamed surface of the finished component does not disturb or is even desired, and the efforts of mold-closing can be avoided.

Example 6

Continuous Process

An casting mold made of ceramic and open on both sides, with a expansion coefficient of 0.5 K−1 was continuously provided from one side with a separating agent foil covered foamable material 14 of an aluminum alloy with TiH2 as the foaming agent. Against a predetermined surface of the casting mold 10, a non-uniform heat radiation was introduced in a controlled manner, and thus, the foaming process started and finished. The foamable metal foamed to fill the space between the mold cover and the mold base, whereas the metal foam surface was always covered by the separating foil, in order to protect the mold from adhesion of the metal foam. The foam was cooled during transportation and left the mold on the other side. The continuously exiting foam product with separating foil coming out of the exit side is then further treated in a desired manner, e.g., cut by water jet, laser etc., or if required, to the desired lengths. The mold or casting mold can then also, itself, be passed by a corresponding radiation field along with the material to be foamed.

Example 7

Mg-foam

A Mg-powder mixture with 9% Al, 1% Zn+1% TiH2 was compacted cold-isostatically and then extruded at 400° C. to long profiles of 20×5 mm. The thus produced foamable semi-finished product was placed into a closable two-part casting mold of graphite and heated in a water-cooled infrared furnace up to 650° C. The inner chamber of the infrared furnace and the casting mold was rinsed during heating with argon gas. The temperature of the casting mold was measured and controlled. The infrared radiation led to high heating ratea (up to approx. 15 K/sec.), whereby the foaming temperature of 650° C. was not exceeded. After switching off the infrared heating, rapid cooling took place. The finished Mg-foam had excellent dimensional precision and a uniform and fine-pored structure.

Obviously, the invention is not restricted to exact the design or composition of the examples listed or described; various changes or deviations from the core and protection scope of the invention are possible, which are known to the experts.

What is claimed is:

1. Method for producing dimensionally accurate metal foam made of foamable, powder-metallurgically produced metal half finished product with a melting point >200° C. by the steps of:

placing foil separating material in a casting mould made of a diathermic material;

introducing the foamable, powder-metallurgically produced metal half finished product that is foamable at a temperature above 200° C. into the casting mould which is heat resistant up to the melting point of the foamable material and having an expansion coefficient on the order of graphite and yttrium oxide with the foil separating material between walls of the casting mould and the foamable material;

closing the casting mould in a gas-tight manner;

controlled heating of the foamable material in the casting mould under conditions producing foaming and dimensionally accurate forming of the faces of the material with the help of radiation emitters whose energy emission is controlled, and which are applied on or through the mould; and removing the thus formed foam product from the mould wherein the casting mould is open on a pair of opposite sides, whereby the foamable material is introduced on one of said sides into the mould, is heated within a selected zone of the mould in said controlled manner and foamed in such a way, that it comes out on an opposite side of the mould as a continuous product in a foamed condition having the cross-sectional shape of the casting mould.

2. Method according to claim 1, comprising the further step of cooling off the mould in a controlled manner after heating.

3. Method according to claim 1, wherein the foaming takes place under a controlled gas atmosphere at a pressure up to a 5 bar.

4. Method according to claim 1, wherein the radiation emission of the radiation emitter is monitored by sensors and controlled according to a monitoring signal.

5. Method according to claim 1, wherein the casting mould is thin-walled, whereby at least one wall thereof has a thickness of 2-20 mm.

6. Method according to claim 1, wherein the casting mould is thin-walled, whereby at least one wall thereof has a thickness of 1-10 mm.

7. Method according to claim 1, wherein the casting mould is thin-walled, whereby at least one wall thereof has a thickness of 2-4 mm.

8. Method according to claim 1, wherein a graphite-containing foil is used as the foil separating material.

9. Method for producing dimensionally accurate metal foam made of foamable, powder-metallurgically produced metal half finished product with a melting point >200° C. by the steps of:

introducing a material that is foamable at a temperature above 200° C. into a casting mould which is heat resistant up to the melting point of the foamable material and having an expansion coefficient on the order of graphite and yttrium oxide;

controlled heating of the foamable material in the casting mould under conditions producing foaming and dimensionally accurate forming of the faces of the material with the help of radiation emitters whose energy emission is controlled, and which are applied on or through the mould; and removing the thus formed foam product from the mould; and wherein the casting mould is open at least at one side thereof.

10. Method for producing dimensionally accurate metal foam made of foamable, powder-metallurgically produced metal half finished product with a melting point >200° C. by the steps of:

introducing a material that is foamable at a temperature above 200° C. into a casting mould which is heat resistant up to the melting point of the foamable material and having an expansion coefficient on the order of graphite and yttrium oxide;

controlled heating of the foamable material in the casting mould under conditions producing foaming and dimensionally accurate forming of the faces of the material with the help of radiation emitters whose energy emission is controlled, and which are applied on or through the mould; and removing the thus formed foam product from the mould; and comprising the further step of supporting at least one wall of the casting mould with supports.

11. Method according to claim 10, wherein the supports are controllable and support the casting mould against a base plate having lower temperature.

12. Method for producing dimensionally accurate metal foam made of foamable, powder-metallurgically produced metal half finished product with a melting point >200° C. by the steps of:

introducing a material that is foamable at a temperature above 200° C. into a casting mould which is heat resistant up to the melting point of the foamable material and having an expansion coefficient on the order of graphite and yttrium oxide;

controlled heating of the foamable material in the casting mould under conditions producing foaming and dimensionally accurate forming of the faces of the material with the help of radiation emitters whose energy emission is controlled, and which are applied on or through the mould; and removing the thus formed foam product from the mould; and comprising the further step using a separating agent between the semi-finished metal product and the mould surface; wherein the casting mould is open on a pair of opposite sides, whereby the foamable material is introduced on one of said sides into the mould along with the separating agent, is heated within a selected zone of the mould in said controlled manner and foamed in such a way, that it comes out on an opposite side of the mould as a continuous product in a foamed condition having the cross-sectional shape of the casting mould.

* * * * *